US007013790B2

(12) United States Patent
Helms et al.

(10) Patent No.: US 7,013,790 B2
(45) Date of Patent: Mar. 21, 2006

(54) SYSTEM AND METHOD FOR DEPLOYING A WEAPON FROM A STEALTH POSITION

(75) Inventors: James Helms, Ft. Myers, FL (US); Thomas G. Buckner, Gibsonia, PA (US)

(73) Assignee: Ibis Tek, LLC, Butler, PA (US)

( * ) Notice: Subject to any disclaimer, the term of this patent is extended or adjusted under 35 U.S.C. 154(b) by 141 days.

(21) Appl. No.: 10/654,649

(22) Filed: Sep. 2, 2003

(65) Prior Publication Data

US 2005/0066806 A1 Mar. 31, 2005

(51) Int. Cl.
*F41A 23/00* (2006.01)

(52) U.S. Cl. ..... 89/38; 89/1.815; 89/1.804

(58) Field of Classification Search ..... 89/38, 89/1.815, 1.804
See application file for complete search history.

(56) References Cited

U.S. PATENT DOCUMENTS 38,118 A * 4/1863 Miller ..... 89/38
382,182 A * 5/1888 Nordenfelt ..... 89/39
2,573,434 A * 10/1951 Graham ..... 89/1.804
3,316,808 A * 5/1967 Mais ..... 89/1.804
4,090,005 A * 5/1978 Morgan ..... 428/76
4,667,565 A * 5/1987 Anderson ..... 89/36.08
4,681,013 A * 7/1987 Farley et al. ..... 89/1.815
5,911,172 A * 6/1999 Korolenko ..... 89/5
5,950,372 A * 9/1999 Al-Sabah et al. ..... 52/66
6,009,791 A * 1/2000 Medlin ..... 89/38
6,733,227 B1 * 5/2004 Fitzgerald et al. ..... 414/486

* cited by examiner

*Primary Examiner*—M. Clement
(74) *Attorney, Agent, or Firm*—Ware, Fressola, Van Der Sluys & Adolphson LLP

(57) ABSTRACT

A stealth weapon module (10) including a weapon support cage (11) and a weapon (12), with the weapon module (10) able to be stowed beneath a retractable hard roof (15). The roof (15) is raised and lowered by a hydraulic motor (16), and includes a stabilizing cloth **(15*b*) that keeps the roof (15), made of interconnected slats (15*a*), from pulling apart or otherwise changing shape as it is raised and lowered, even at rates of travel of several inches per second. The weapon module (10), with any of various different roof designs including the retractable hard roof (15), can be incorporated into either a transportable shell (20)**, able to be moved from one application to another, or can be built into (and so specially adapted to) a structure, such as the back/cab of a sports utility vehicle.

16 Claims, 4 Drawing Sheets

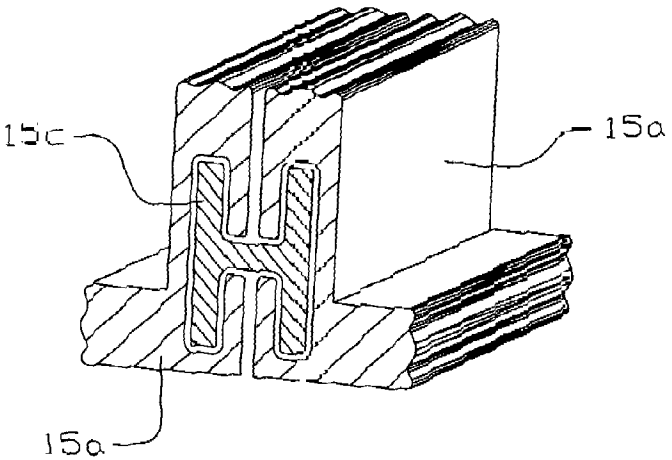
FIG. 5
FIG. 4
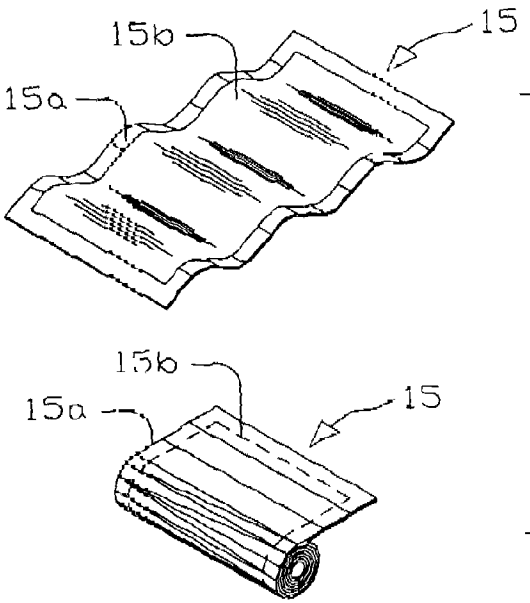

SYSTEM AND METHOD FOR DEPLOYING A WEAPON FROM A STEALTH POSITION

TECHNICAL FIELD

The present invention pertains to a weapon system—such as a turret for a machine gun or a missile launcher—and associated equipment, and more particularly to a machine for raising and lowering a weapon system from a stowed position to a deployed position so as to make the weapon suitable for a stealth mission, and also more particularly to providing an enclosure for a weapon so as to make the weapon suitable for a stealth mission.

BACKGROUND ART

Today there are many uses for a stealth weapon, i.e. a weapon normally hidden from view in an enclosure of a type not normally having a weapon, such as the back of a sport utility vehicle or a (covered) cab (back-end) of a pickup truck type vehicle. Such uses include e.g. some homeland defense missions, VIP (very important person) escort, reconnaissance, security patrol, and transport of special cargo (such as nuclear material), or any mission in which it is advantageous to avoid drawing attention to the mission but is important to have the ability to respond to a threat to the mission.

In response to the demand for stealth weapons, the prior art teaches providing a weapon system cage enclosed in the back of one or another of various types of commercial civilian vehicles (such as a sport utility vehicle or a cab of a pickup type truck) and including a weapon (such as a 50-caliber—i.e. a 12.7 mm or 0.50" caliber—machine gun) on a lift platform, the lift platform for raising and lowering the weapon through an opening in the ceiling of the vehicle, with the opening normally covered by a retractable roof. The operation of the lift platform, retractable roof, and the weapon itself is controlled from an operator control station in typically the front passenger seat (the "shotgun" seat, as in "riding shotgun").

In respect to the retractable roof, the prior art teaches a cloth roof able to be rolled up when retracted. The roof is raised and retracted by an electric motor. Such a roof is of course of light weight, and electric motors with sufficient power and torque to raise and lower such a roof in a reasonably short time, as required by a stealth mission, are readily available.

The prior art in respect to a cloth retractable roof has one major problem. A cloth roof can be easily cut with a knife. It would therefore be advantageous to replace a cloth retractable roof with a hard roof. Such roofs do exist for use on commercial trucks; they are used to cover the beds of pickup truck type vehicles. Hard bendable roofs suitable for such use are available from Pace Edwards, and are provided as interconnected slats allowing the roofs to be rolled up when retracted. Adjacent slats are flexibly interconnected by a strip of rubber having bulbous edges inserted in recesses in adjacent slats. The slats are so formed as to be able to bend or fold toward each other (typically in only one direction, with the result that the roof can be rolled up only always with one side or face of the roof on the inside in the rolled-up configuration). The roof is raised and retracted by an electric motor having a drive gear coupled via timing belts and a shaft to timing gears that turn sprockets that grip the roof so as to allow raising and lowering the roof.

Using such a retractable hard roof for a stealth application poses two problems. First, because the roof must be raised and retracted quickly (so as to have a travel rate of typically at least several inches per second), adjacent slats sometimes pull apart because the rubber strip holding them together, which must be reasonably soft to allow the roof to bend, are so soft as to deform under the forces applied to raise and retract the roof quickly, and when deformed, the rubber strips pull free of the recesses in the slats, so the door splits apart. Also, again as a result of the speed with which the roof must be moved, and also owing to the play and separation between the slats on account of the soft rubber strips holding the slats together, even if equal forces are applied in perfect synchrony at both edges of the roof, the roof sometimes binds at least momentarily while being moved. To use such a roof in a stealth application requires therefore a way of improving the stability of the roof structure in respect to the above deficiencies, without diminishing the flexibility needed for retracting the roof into a rolled-up configuration.

Another problem with the prior art—this time generally in respect to the roof but more specifically in respect to the motor used to raise and lower/retract the roof—is that to raise the roof (typically 35 pounds, as noted above) quickly (typically on the order of 300 inches per minute) requires something on the order of 1 horsepower turning at 200 rpm. An electric motor (D.C. or even A.C.) meeting such specifications tends to be expensive (because of typically having to turn at a higher speed and then gearing down to the 200 rpm to provide the required horsepower). In addition, an electric motor will overheat sooner in a high-temperature environment, and many stealth missions are carried out in such an environment, such as in deserts of the Middle East, where the ambient can be 54 degrees Centigrade. What is therefore also needed is a low cost, durable motor, relatively insensitive to high temperature, for raising and retracting a relatively heavy (30 to 40-pound) hard roof.

In respect to encapsulating the weapon in an enclosure, what the prior art teaches is embedding the stealth weapon in a vehicle, i.e. building a stealth weapon into the vehicle so as to incorporate the weapon as part of the vehicle. The stealth weapon is of course used rarely, if at all, and so the vehicle quite expensive) stealth weapon. So it would be advantageous to have a stealth weapon with at least the weapon itself (as opposed to the operator control station) and the machine for raising and lowering the weapon packaged so as to be moveable, essentially intact, from one vehicle to another, or more generally to be transportable intact from one application/location to another.

DISCLOSURE OF THE INVENTION

Accordingly, in a first aspect of the invention, a system is provided comprising: a weapon support cage having a frame and a lift platform attached to the frame for raising and lowering a weapon, and having a retractable roof for covering the weapon when the weapon is in its lowered position, and also having means for deploying and retracting the roof, the weapon support cage responsive to hoist control signals for raising and lowering the lift platform and for retracting and deploying the roof; and an operator control station for providing the hoist control signals; characterized in that the roof is made substantially of a hard material.

In accord with the first aspect of the invention, the roof may be a bendable structure comprising elongated slats each interconnected to at least one other along an edge so as to be able to be wound from a flat configuration to a rolled-up configuration and conversely. Further, the roof may have a substantially non-extensible cloth adhered to a face of the roof so as to extend across at least some or substantially all of the slats forming the face of the roof. Still further, the cloth may be of a material having an especially low coefficient of thermal expansion. Further still, the cloth may be an acrylic yarn.

Also in accord with the first aspect of the invention, the roof may be deployed and retracted using a hydraulic motor. Further, the hydraulic motor may have a veined structure and a shaft coupled to the veined structure, and may have an opening to a hydraulic line through which hydraulic fluid is forced from a hydraulic reservoir by a pump, and may also have a hydraulic line for returning hydraulic fluid to the hydraulic reservoir, and the veined structure may be configured so as to turn the hydraulic motor shaft in one or another direction in response to a difference in pressure in hydraulic lines connected to the hydraulic motor. Further, the hydraulic motor may be provided with hydraulic fluid at a plurality of pressures so as to provide a corresponding plurality of motor speeds at a given load. Still further, the hydraulic motor may have a protruding shaft on which a drive gear is mounted on which in turn a timing belt is wound which in turn is wound onto a timing gear on a timing axle rotatably connected to the weapon support cage and having a sprocket for mating with recesses between the slats of the roof and so providing purchase for urging the roof from a retracted configuration to a deployed configuration, and vice versa.

Also in accord with the first aspect of the invention, the weapon support cage may be enclosed in a shell having an electric power interface for receiving electric power, a control signal interface for receiving the control signals, and a sensor signal interface for providing the sensor signals, with the shell transportable intact from one application to another. Further, the shell may be provided with attachment means so as to fit as a cab or fixture to any vehicle or vessel of a predetermined one or more types. Also further, the system may also comprise a weapon module including the weapon support cage and may also include the weapon, and the weapon module may be further responsive to weapon control signals by which the weapon is operative, and may provide sensor signals conveying information acquired from sensors also included as part of the weapon module, and further, the operator control station may be responsive to the sensor signals and may provide the weapon control signals.

In a second aspect of the invention, a method is provided for raising a weapon from a concealed position and for lowering the weapon back to the concealed position, the method comprising steps of using the equipment provided according to the first aspect of the invention.

BRIEF DESCRIPTION OF THE DRAWINGS

The above and other objects, features and advantages of the invention will become apparent from a consideration of the subsequent detailed description presented in connection with accompanying drawings, in which:

FIG. 4 is a perspective drawing of the roof according to the invention in both the substantially unwound/flat position and also in a rolled-up configuration.

FIG. 5 is a cross-section of the roof shown in FIG. 4.

BEST MODE FOR CARRYING OUT THE INVENTION

Figure 1A:
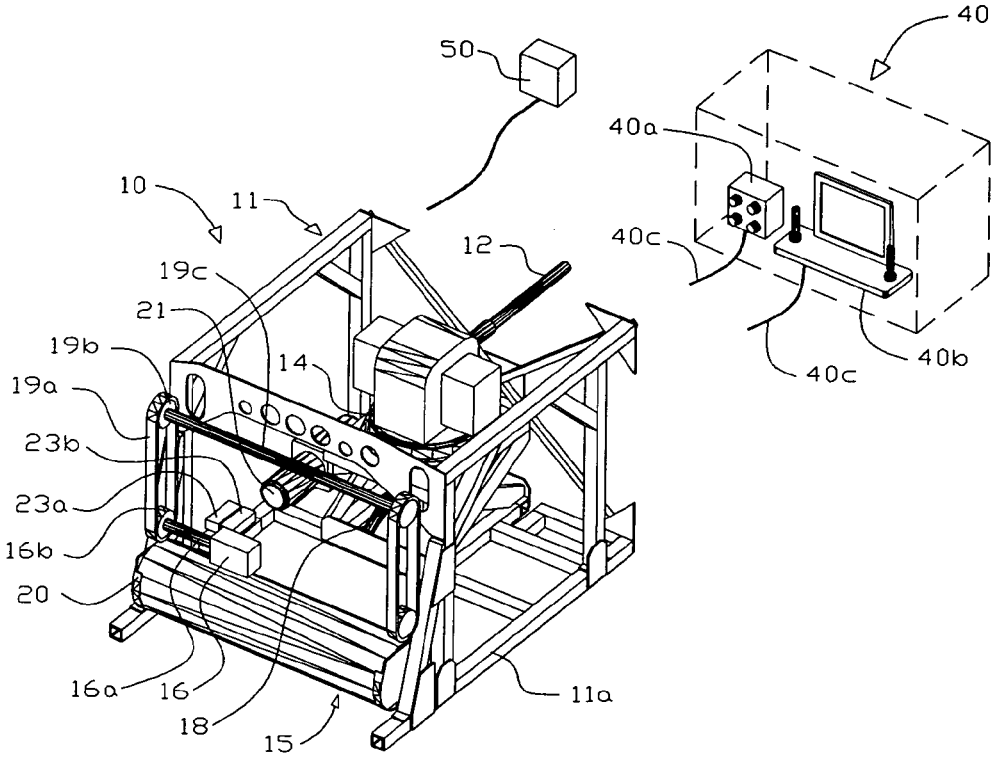
FIG. 1A is a perspective drawing of a weapon system cage according to the invention, including a stabilized retractable hard roof raised and lowered under the urging of a hydraulic motor, and also having a lift platform onto which is attached a weapon, with the weapon, roof and lift platform electrically coupled to a separately located operator control station, also shown.
Figure 1B:
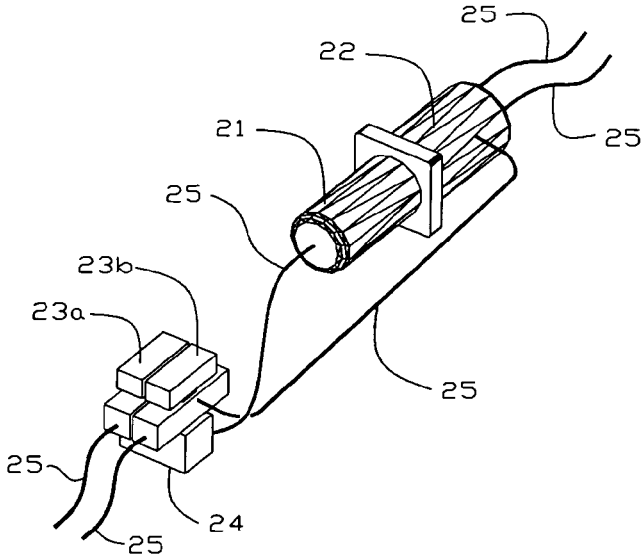
FIG. 1B is a perspective drawing showing the hydraulic motor and associated equipment of FIG. 1A in greater detail.

Referring now to FIGS. 1A and 1B, a weapon module 10 is shown including a weapons support cage 11 having a frame 11*a* to which is attached a lift platform 14 for raising and lowering a weapon 12 attached to the lift platform. As shown, the weapon module 10 includes a hydraulic motor 16 having a veined structure (not shown), i.e. having in essence a rotor or screw that turns in response to hydraulic fluid from a hydraulic reservoir 22 being forced through connecting hydraulic lines 25 under the urging of an electric pump 21. The turning of the veined structure results in raising or lowering/retracting of a hard roof 15 consisting essentially of spaced apart slats 15*a*, via coupling of the roof to the hydraulic motor by an arrangement of a drive gear 16*b* on a shaft 16*a* turned by the hydraulic motor 16, two timing belts 19*a*, two corresponding pairs of timing gears 19*b*, a timing axle 19*c* connecting one timing gear (the top gear) of each pair, and four sprockets 20 for gripping the roof by arranging for teeth of the sprockets to meet with spaces between the slats of the roof, spaces that occur only at the extremities of the width of the roof because rubber strips 15*c*, described in more detail below in connection with FIGS. 4 and 5, which flexibly couple adjacent slats, fill the inter-slat space except at the extremities of the roof (where the sprockets grip the roof).

The hydraulic motor 16 used to raise and lower the retractable roof 15 is typically of a type able to provide from ½ to 1 horsepower and turn at approximately 200 rpm under the urging of the electric pump 21 providing hydraulic fluid from the hydraulic reservoir 22 at a maximum pressure of of 10,000 psi, with normal working pressure of 500–600 psi. Such a hydraulic pump is available for example from Cool Cars Inc., which provides so-called CCE hydraulics (via the online catalog at www.coolcars.org).

The hydraulic cylinder 18 and the hydraulic motor 16 both act in response to hydraulic pressure provided by the electric pump 21 pumping hydraulic fluid from the hydraulic reservoir 22 into the hydraulic lines 25 connecting the pump 21, via hydraulic valves 23*a* 23*b*, to the hydraulic motor 16 and to the hydraulic cylinder 18 (respectively). A switch 24, operative according to the hoist control signals, directs the hydraulic fluid to either a hydraulic cylinder 18 (serving in effect as a hydraulic motor) for providing the motive force for the lift platform 14 or to the hydraulic motor 16 providing the motive force for the retractable roof 15.

In order to arrange that the roof 15 comes to a stop at the end of its intended travel without undue force to prevent its overshooting its intended stopping point, the hydraulic pump 16 is provided with hydraulic fluid at a typically at least two pressures so as to provide a two corresponding motor speeds at a given load (the roof). This is accomplished by including a t-valve as the valve 23*b* for providing the hydraulic fluid to the hydraulic motor 16. The t-valve is responsive to the hoist control signals from the hoist control interface 40*a*; near the end of the intended travel of the roof, the hoist control signals cause the t-valve to shunt a predetermined fraction of the hydraulic fluid back to the hydraulic reservoir 22, thus slowing the roof down sufficiently far in advance of the end of its intended travel that the inertia of the roof will not result in its overshooting its stopping point.

Still referring to FIGS. 1A and 1B, the weapon module 10 is coupled to an operator control station 40 by cabling 40*c* (or wirelessly, e.g. by infrared signalling) for receiving sensor signals (including e.g. video feed from a camera mounted on the weapon, but also from other sensors incorporated into the weapon module), and for providing hoist control signals for raising and retracting the roof 15 and for raising and lowering the lift platform 14, and also for providing weapon control signals for operating the weapon 12. The operator control station includes a hoist interface 40*a* for providing the hoist control signals and a weapon interface 40*b* for providing the weapon control signals (including signals for aiming and firing the weapon) and for receiving the sensor signals.

The hoist interface 40*a* typically includes problem-avoidance logic. Thus, e.g., if an operator attempts to raise the weapon 13 before retracting the roof 15, the hoist interface 40*a* will first retract the roof 15 and then raise the lift platform 14. To avoid problems, the hoist interface 40*a* can send control signals always assuming a safe state as the current state. Thus, e.g., to raise the weapon, even if the weapon is already raised, the hoist interface assumes the roof is deployed (and the weapon is stowed), and sends control signals to first retract the roof, and then raise the lift platform.

Still referring to FIGS. 1A and 1B, the weapon module 10 is also coupled to an electric power source 50 (typically a battery) for receiving electric power for operation of the electric motor of the hydraulic pump, and for receiving power for motors (not shown) for aiming and firing the weapon and for operation of weapon-mounted sensors (not shown).

Figure 2A:
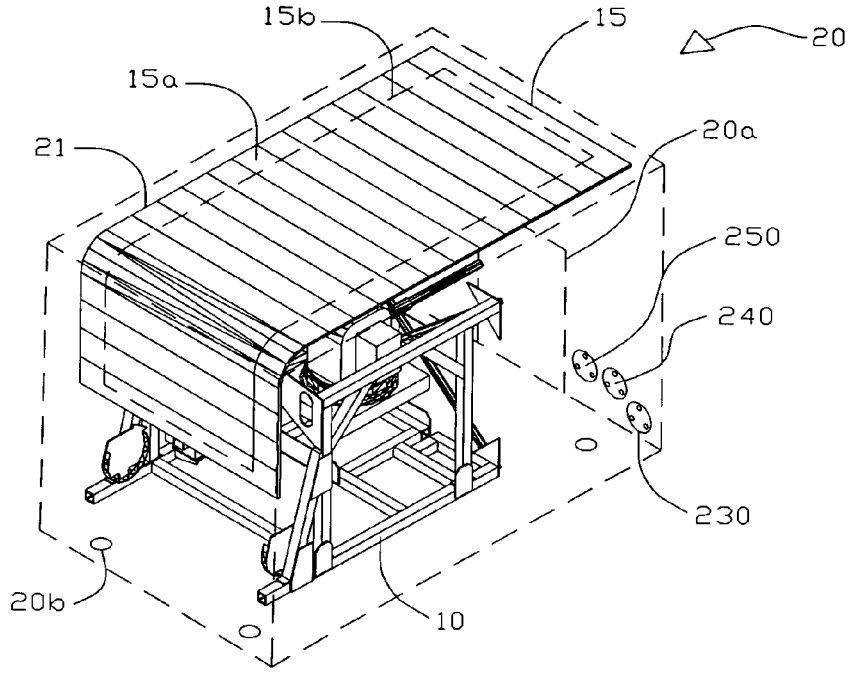
FIG. 2A is a perspective drawing of a transportable cab/shell enclosing a weapon system cage and the weapon both shown in FIG. 1, with the weapon in the lowered/stowed position.
Figure 2B:
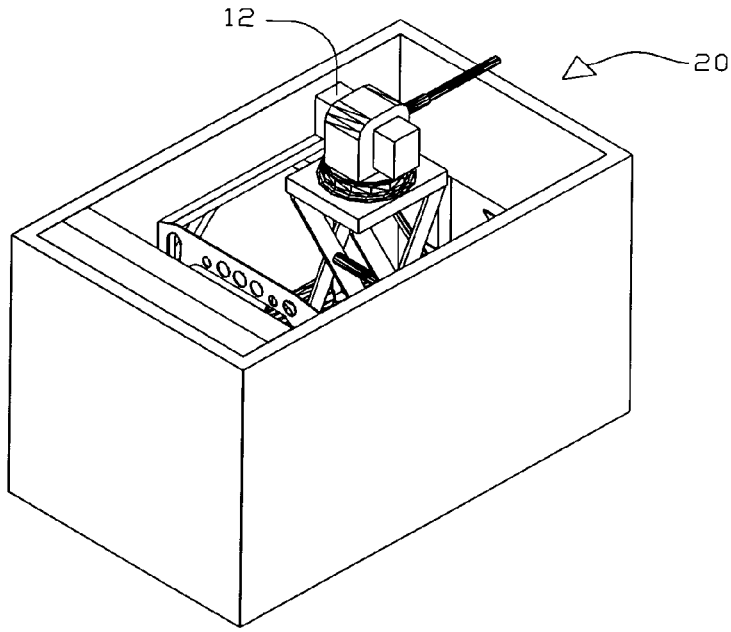
FIG. 2B is a perspective drawing of the transportable cab/shell of FIG. 2A with the weapon raised to its firing position.

Referring now to FIGS. 2A and 2B, an embodiment of the invention is shown in which the weapon module 10 is built into a transportable shell 20, the weapon module 10 being shown in its stowed configuration in FIG. 2A, and deployed in FIG. 2B. The roof 15 is shown in its raised/deployed position in FIG. 2A, with two edges inserted in shell roof guides 21 built into the shell and mating with cage roof guides (not shown) built into the cage 11. The shell 20 has a portal 20*a* allowing access to the weapon module 10 for maintenance, even in its stowed position. The portal 20*a* can be provided for example as a sliding door, as shown, or it could even be an uncovered access. Cabling for power, control signals, and sensor signals can pass through the portal or can plug into the shell at corresponding plugs, such as an electric power interface 230, a sensor signal interface 240, and a (hoist and weapon) control signal interface 250.

Figure 3:
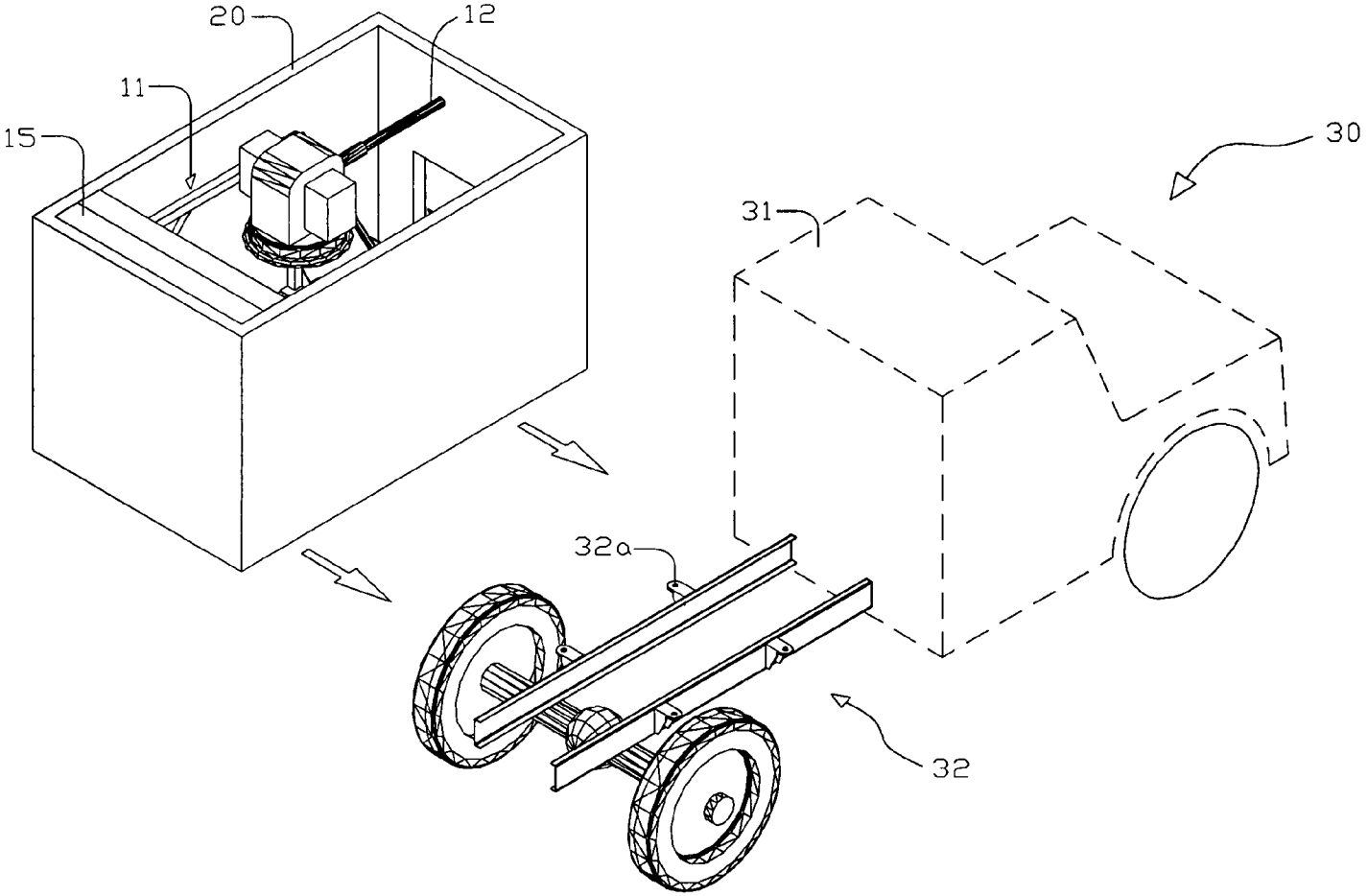
FIG. 3 is an isometric drawing of the transportable cab/shell of FIGS. 2A and 2B, showing the cab/shell being moved onto the frame of a pickup truck-type vehicle.

Referring now also to FIG. 3, the shell is provided with an array of shell attachment means 20*b* that vary according to the application. For use as a transportable cab attached to the frame of a pickup truck type vehicle 30, the attachment means can be the same as are usually found on cabs for attaching cabs to pickup truck type vehicles for which the cabs are designed—i.e. an array of holes 20*b* of predetermined size and corresponding bolts (not shown) for bolting the cab/shell 20 to the vehicle cab frame 32 using the standard cab interface bolting locations 32*a* provided with the vehicle cab frame 32. For marine applications, i.e. onboard a vessel, the attachment means can be standardized for vessels of a given type—and again would normally consist of an array of bolt (or screw) holes and corresponding bolts (or screws). Alternatively, for any application, instead of a predetermined attachment means, the means of attaching the shell—if any is used—can be determined at the time of providing the shell for an application.

Referring again to only FIGS. 2A and 2A, the shell 20 can be substantially metallic (such as either still or aluminum) with a hard plastic floor and in some applications can include openings (not shown) for ventilation. In some instances—typically marine applications—the shell is preferably a composite material (fiberglass, e.g. or even simply some form of hard plastic) so as not to rust.

Referring again to FIG. 1A, the operator control station 40 can also be transportable; it can be even simply in essence a moveable box, although the weapon control signals for arming and firing are typically provided using control handles, which would therefore protrude out from the box. A video display is also typically used in aiming the weapon (although a heads up display can also be used) and in case of the operator control station including such a video display, the display screen can constitute substantially all of one face of the box. In most vehicle applications, however, the operator control station is integrated into the vehicle so as to be operable from the front passenger seat.

Referring to FIG. 4 again and now also to FIG. 5, the slatted roof 15 is shown as having a stabilizer cloth 15*b* adhered to at least part of substantially all of the slats 15*a* of the roof. The stabilizer cloth is of a material that is substantially non-stretchable, and has a low coefficient of thermal expansion. A so-called Sunbrella fabric, made of acrylic yarns, is useful as a stabilizing cloth. (Sunbrella is a trademark of Glen Raven Mills, Inc., now known as Glen Raven, Inc., of Glen Raven, N.C.) Sunbrella fabric is available for example from Scottie's Canvas and Marine Outfitters in North Ft. Myers, Fla. The stabilizer cloth 15*b* is adhered to the roof 15 using a suitable glue or epoxy, such as a high-temperature spray glue.

Referring now in particular to FIG. 5, where a portion of two adjacent slats are shown in cross-section at a point along the width of the slats where an interconnecting rubber strip 15*c* is present (and so away from the extremities of the edges of the slats, where the rubber strip is absent so as to make space for sprockets being turned by the timing gears of the hoist assembly), the rubber strip 15*c* is shown as having two bulbous protuberances that insert into corresponding appropriately sized recesses/cavities in the slats 15*a*, and so prevent the slats from pulling apart unless force is applied sufficient to deform the rubber strips so that the protuberances bend and pull through the opening leading from one slat to the other. The rubber strips 15*c* are actually of sufficient thickness to substantially fill the recesses/cavities in the slats, and so prevent water from leaking through the roof.

It should be understood that adjacent roof slats 15*a* can of course be held together by means other than rubber strips 15*c*. For example, adjacent slats 15*a* can be held together by a steel hinged (bendable) strip instead of a rubber strip, with the result that the roof provides even more protection against intrusion. In such embodiments, the stabilizing cloth 15*b* can still be used, but depending on the application, stabilizing may not be needed with steel strips used in place of the rubber strips 15*c*. If not, and if waterproofing is needed, a bendable waterproof covering (e.g. plastic or waterproof cloth) can be adhered to the roof 15.

As an alternative to using strips at all, either rubber or metallic, the slats 15*a* of the roof 15 can be interconnected by hinges built into the slats, made typically from the same material as the slats.

Also, it should be noted that the roof 15 need not even be a slatted structure. A hard roof can be provided as two or more doors that open outward, away from the weapon support cage 11, or inward, toward the cage. In such embodiments, the roof is made to retract by opening the doors, and is deployed by closing the doors.

It is to be understood that the above-described arrangements are only illustrative of the application of the principles of the present invention. Numerous modifications and alternative arrangements may be devised by those skilled in the art without departing from the scope of the present invention, and the appended claims are intended to cover such modifications and arrangements.

What is claimed is:

1. A system comprising:

a weapon support cage (11) having a frame (11*a*) and a lift platform (14) attached to the frame (11*a*) for raising and lowering a weapon (12), and having a retractable roof (15) for covering the weapon (12) when the weapon is in its lowered position, and also having means (16) for deploying and retracting the roof (15), the weapon support cage (11) responsive to hoist control signals for raising and lowering the lift platform (14) and for retracting and deploying the roof (15); and an operator control station (40) for providing the hoist control signals;

characterized in that the roof (15) is made substantially of a hard material (15*a*) and is provided as a bendable structure such that the roof can be rolled from a flat configuration to a rolled up configuration and conversely, and the roof is rolled up as it is retracted;

further characterized in that the roof (15) is deployed and retracted using a hydraulic motor (16);

and further characterized in that the hydraulic motor (16) is provided with hydraulic fluid at a plurality of pressures so as to provide a corresponding plurality of motor speeds at a given load.

2. The system of claim 1, further characterized in that: the roof (15) is a bendable structure comprising elongated slats (15*a*) each interconnected to at least one other along an edge so as to be able to be wound from a flat configuration to a rolled-up configuration and conversely.

3. The system of claim 2, further characterized in that: the roof (15) has a substantially non-extensible cloth (15*b*) adhered to a face of the roof (15) so as to extend across at least some or substantially all of the slats (15*a*) forming the face of the roof (15).

4. The system of claim 3, further characterized in that: the cloth (15*b*) is of a material having an especially low coefficient of thermal expansion.

5. The system of claim 4, further characterized in that: the cloth (15*b*) is an acrylic yarn.

6. A system comprising:

a weapon support cage (11) having a frame (11*a*) and a lift platform (14) attached to the frame (11*a*) for raising and lowering a weapon (12), and having a retractable roof (15) for covering the weapon (12) when the weapon is in its lowered position, and also having means (16) for deploying and retracting the roof (15), the weapon support cage (11) responsive to hoist control signals for raising and lowering the lift platform (14) and for retracting and deploying the roof (15); and an operator control station (40) for providing the hoist control signals;

characterized in that the roof (15) is made substantially of a hard material (15*a*) and is provided as a bendable structure such that the roof can be rolled from a flat configuration to a rolled up configuration and conversely, and the roof is rolled up as it is retracted;

further characterized in that the roof (15) is deployed and retracted using a hydraulic motor (16); and further characterized in that: the hydraulic motor (16) has a veined structure and a shaft (16*a*) coupled to the veined structure, and has an opening to a hydraulic line (25) through which hydraulic fluid is forced from a hydraulic reservoir (22) by a pump (21), and also having a hydraulic line (25) for returning hydraulic fluid to the hydraulic reservoir (22), the veined structure configured so as to turn the hydraulic motor shaft (16*a*) in one or another direction in response to a difference in pressure in hydraulic lines (25) connected to the hydraulic motor (16).

7. A system comprising:

a weapon support cage (11) having a frame (11*a*) and a lift platform (14) attached to the frame (11*a*) for raising and lowering a weapon (12), and having a retractable roof (15) for covering the weapon (12) when the weapon is in its lowered position, and also having means (16) for deploying and retracting the roof (15), the weapon support cage (11) responsive to hoist control signals for raising and lowering the lift platform (14) and for retracting and deploying the roof (15); and an operator control station (40) for providing the hoist control signals;

characterized in that the roof (15) is made substantially of a hard material (15*a*) and is provided as a bendable structure such that the roof can be rolled from a flat configuration to a rolled up configuration and conversely, and the roof is rolled up as it is retracted;

further characterized in that the roof (15) is deployed and retracted using a hydraulic motor (16); and further characterized in that: the hydraulic motor (16) has a protruding shaft (16*a*) on which a drive gear (16*b*) is mounted on which in turn a timing belt (19*a*) is wound which in turn is wound onto a timing gear (19*b*) on a timing axle (19*c*) rotatably connected to the weapon support cage (11) and having a sprocket (20) for mating with recesses between the slats (15*a*) of the roof (15) and so providing purchase for urging the roof (15) from a retracted configuration to a deployed configuration, and vice versa.

8. The system of claim 1, further characterized in that the weapon support cage (11) is enclosed in a shell (20) having an electric power interface (230) for receiving electric power, a control signal interface (250) for receiving the control signals, and a sensor signal interface (240) for providing the sensor signals, wherein the shell (20) is transportable intact from one application to another.

9. The system of claim 8, further characterized in that the shell is provided with attachment means (20*b*) so as to fit as a cab or fixture to any vehicle or vessel of a predetermined one or more types.

10. A system comprising:

a weapon support cage (11) having a frame (11*a*) and a lift platform (14) attached to the frame (11*a*) for raising and lowering a weapon (12), and having a retractable roof (15) for covering the weapon (12) when the weapon is in its lowered position, and also having means (16) for deploying and retracting the roof (15), the weapon support cage (11) responsive to hoist control signals for raising and lowering the lift platform (14) and for retracting and deploying the roof (15); and an operator control station (40) for providing the hoist control signals;

characterized in that the roof (15) is made substantially of a hard material (15*a*) and is provided as a bendable structure such that the roof can be rolled from a flat configuration to a rolled up configuration and conversely, and the roof is rolled up as it is retracted;

further characterized in that the weapon support cage (11) is enclosed in a shell (20) having an electric power interface (230) for receiving electric power, a control signal interface (250) for receiving the control signals, and a sensor signal interface (240) for providing the sensor signals, wherein the shell (20) is transportable intact from one application to another; and further comprising a weapon module (10) including the weapon support cage (11) and also including the weapon (12), and wherein the weapon module (10) is further responsive to weapon control signals by which the weapon (12) is operative, and provides sensor signals conveying information acquired from sensors (12*a*) also included as part of the weapon module (10), and further wherein the operator control station (40) is responsive to the sensor signals and provides the weapon control signals.

11. A method for raising a weapon (12) from a concealed position and for lowering the weapon (12) back to the concealed position, comprising:

a step of housing the weapon (12) in a weapon support cage (11) having a frame (11*a*) and a lift platform (14) attached to the frame (11*a*) for raising and lowering the weapon (12), and having a retractable roof (15) for covering the weapon (12) when the weapon is in its lowered position, and also having means (16) for deploying and retracting the roof (15), the weapon support cage (11) responsive to hoist control signals for raising and lowering the lift platform (14) and for retracting and deploying the roof (15); and a step of controlling the position of the roof (15) and the lift platform (14) via an operator control station (40) providing the hoist control signals;

characterized in that the roof (15) is made substantially of a hard material (15*a*) and is provided as a bendable structure such that the roof can be rolled from a flat configuration to a rolled up configuration and conversely, and the roof is rolled up as it is retracted;

further characterized in that the roof (15) is deployed and retracted using a hydraulic motor (16);

and further characterized in that: the hydraulic motor (16) has a veined structure and a shaft (16*a*) coupled to the veined structure, and has an opening to a hydraulic line (25) through which hydraulic fluid is forced from a hydraulic reservoir (22) by a pump (21), and also having a hydraulic line (25) for returning hydraulic fluid to the hydraulic reservoir (22), the veined structure configured so as to turn the hydraulic motor shaft (16*a*) in one or another direction in response to a difference in pressure in hydraulic lines (25) connected to the hydraulic motor (16).

12. The method of claim 11, further characterized in that: the roof (15) is a bendable structure comprising elongated slats (15*a*) each interconnected to at least one other along an edge so as to be able to be wound from a flat configuration to a rolled-up configuration and conversely.

13. The method of claim 12, further characterized in that: the roof (15) has a substantially non-extensible cloth (15*b*) adhered to a face of the roof (15) so as to extend across at least some or substantially all of the slats (15*a*) forming the face of the roof (15).

14. The method of claim 12, further characterized in that: the cloth (15*b*) is of a material having an especially low coefficient of thermal expansion.

15. The method of claim 11, further characterized in that: the hydraulic motor (16) is provided with hydraulic fluid at a plurality of pressures so as to provide a corresponding plurality of motor speeds at a given load.

16. The method of claim 11, further characterized in that the weapon support cage (11) is enclosed in a shell (20) having an electric power interface (230) for receiving electric power, a control signal interface (250) for receiving the control signals, and a sensor signal interface (240) for providing the sensor signals, wherein the shell (20) is transportable intact from one application to another.

* * * * *

UNITED STATES PATENT AND TRADEMARK OFFICE

CERTIFICATE OF CORRECTION

PATENT NO. : 7,013,790 B2
APPLICATION NO. : 10/654649
DATED : March 21, 2006
INVENTOR(S) : Helms et al.

It is certified that error appears in the above-identified patent and that said Letters Patent is hereby corrected as shown below:

At column 2, line 40: Please delete "vehicle quite expensive) stealth weapon" and substitute --vehicle will usually wear out before the (quite expensive) stealth weapon-- therefor.

Signed and Sealed this

First Day of August, 2006

JON W. DUDAS
*Director of the United States Patent and Trademark Office*